US007588302B2

(12) United States Patent
Bastani et al.

(10) Patent No.: US 7,588,302 B2
(45) Date of Patent: Sep. 15, 2009

(54) SYSTEM AND METHOD FOR DETECTING PEN-TO-PAPER SPACING IN A PRINTING SYSTEM

(75) Inventors: Behnam Bastani, San Diego, CA (US); Jorge Miguel Gomez, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 327 days.

(21) Appl. No.: 11/496,371

(22) Filed: Jul. 31, 2006

(65) Prior Publication Data

US 2008/0024531 A1 Jan. 31, 2008

(51) Int. Cl.
*B41J 25/308* (2006.01)

(52) U.S. Cl. ..... 347/8

(58) Field of Classification Search ..... 400/55–60
See application file for complete search history.

(56) References Cited

U.S. PATENT DOCUMENTS 5,808,651 A * 9/1998 Horiuchi ..... 347/131
6,027,264 A 2/2000 Maher et al.
6,623,096 B1 9/2003 Castano et al.
6,666,537 B1 12/2003 Kelley et al.
6,755,499 B2 6/2004 Castano et al.
7,014,289 B1 * 3/2006 Matsuda ..... 347/19
7,044,575 B2 5/2006 Kelley et al.
7,156,482 B2 1/2007 Boleda et al.
2004/0021724 A1 * 2/2004 Kojima ..... 347/19
2004/0056911 A1 3/2004 Fairchild et al.
2005/0280665 A1 * 12/2005 Flotats et al. ..... 347/8
2006/0132515 A1 6/2006 Buonerba et al.

* cited by examiner

*Primary Examiner*—Matthew Luu
*Assistant Examiner*—Justin Seo

(57) ABSTRACT

A system for detecting pen-to-paper spacing (PPS) in a printing system having a pen attached to a moveable print head positioned near a print media position, includes a test pattern, at the print media position, a sensor device, attached to the print head, and a controller. The test pattern includes printed lines having a line dimension, and the sensor device is positioned to shine light upon, and detect light reflected from the test pattern as the print head scans across the test pattern. The controller is connected to receive reflectance signals from the reflectance sensor, and configured to determine line dimensions in the test pattern and compare said line dimensions with predetermined line dimension values for the test pattern to determine variation in the PPS.

19 Claims, 4 Drawing Sheets

SYSTEM AND METHOD FOR DETECTING PEN-TO-PAPER SPACING IN A PRINTING SYSTEM

BACKGROUND

In ink jet printers, the physical distance between the ink jet pen and the paper or other media upon which the ink is being ejected, known as the pen-to-paper spacing (PPS), has a significant effect on the quality of the printing. If the PPS varies outside a relatively narrow tolerance range, depending upon the particular printer, the quality of printed images is noticeably affected. Careful control of the pen-to-paper spacing improves positioning of the ink drops, which in turn produces better images.

The pen-to-paper spacing in a printer can change throughout the printer's lifetime due to a variety of factors, such as paper jams, printer handling, servicing, pen changes, etc. Some ink jet printers, particularly lower cost models, are not designed to allow adjustment of the pen-to-paper spacing after the printer leaves the factory. With these printers, some slight variation in the PPS over time is expected, along with a corresponding variation in print quality.

Other printers, particularly high-end color photographic printers, are configured to allow the PPS to be checked and adjusted periodically. Some printers in this category are designed as photographic printers, and can print high-resolution digital photographs on high quality photographic paper. In order to maintain high quality printing, it is desirable that the uniformity of the PPS be accurately maintained in these printers. Under current methods, checking the uniformity of pen-to-paper spacing in an ink jet printer is a relatively complicated and time-consuming process. Checking the PPS takes a skilled technician several minutes using an expensive measuring tool that the technician has been trained to operate. Only after the spacing has been checked can the technician then make any necessary adjustments.

BRIEF DESCRIPTION OF THE DRAWINGS

Various features and advantages of the invention will be apparent from the detailed description which follows, taken in conjunction with the accompanying drawings, which together illustrate, by way of example, features of the invention, and wherein.

DETAILED DESCRIPTION

Figure 1:
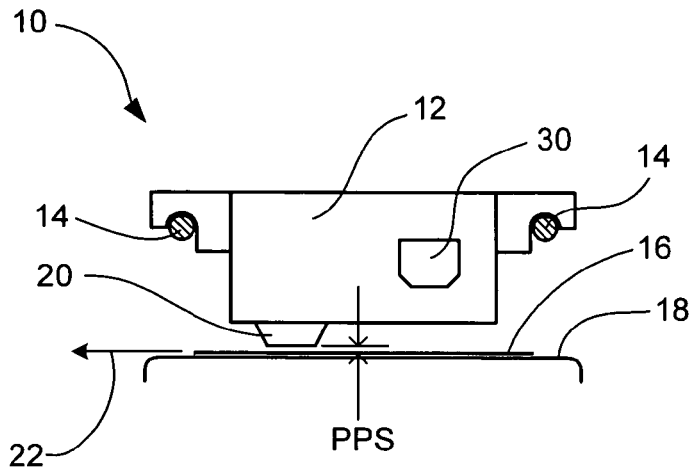
FIG. 1 is a cross-sectional view of an embodiment of a pen-to-paper spacing sensor unit attached to a moveable carriage of a printing system.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated herein, which would occur to one skilled in the relevant art and having possession of this disclosure, are to be considered within the scope of the invention.

As noted above, the pen-to-paper spacing (PPS) in a printing system can affect the print quality. However, the PPS can change throughout a printer's lifetime due to paper jams, printer handling, servicing, pen changes, etc. Checking PPS uniformity is typically performed by a specially-trained technician using an expensive external tool.

Automatic calibrations are a desirable feature in stand-alone printers, such as those in self-service photo printing kiosks and the like. Providing such stand-alone printers with automatic calibration capabilities can help improve the serviceability and print quality for these installations, and help reduce maintenance costs. A number of automatic calibration techniques, such as Automatic Pen Alignment (APA) and Closed Loop Calibration (CLC), have already been incorporated into ink jet printers. However, these automatic calibrations generally require a uniform PPS in order to be accurate. Thus, checking and adjustment of the PPS may be desirable before these other automatic calibrations are performed. As noted above, under current methods, these automatic calibrations may require a technician to first check the PPS.

The inventors have recognized that it would be desirable to have a simpler and more automatic system and method for checking the pen-to-paper spacing in an ink jet printer. Accordingly, the inventors have developed a simple automatic system and method for measuring the PPS in an ink jet printer. This allows the PPS check to be done internally, without the need for an external tool, thus making the process simpler and less expensive. The system and method allows measurement of the absolute PPS and also of the change in PPS across the print area. An absolute PPS measurement is useful for indicating whether the system is within the desired range. Relative PPS measurement is desirable in order to determine the uniformity of the PPS. One advantage of measuring the relative PPS is that this measurement tends to be very accurate.

Shown in FIG. 1 is a portion of an ink jet printer system 10, shown in cross-section, which includes an automatic PPS sensor system. Like typical ink jet printer systems, the printer includes a moveable print head carriage 12, which slides back and forth (in and out of the plane of the drawing) upon a pair of rails 14 (shown in cross-section) over a piece of print media 16 that is upon a media support surface 18, such as a plate or drum. The print head carriage supports the pen 20, which includes a plurality of ink jet orifices (not shown), and ejects ink droplets onto the print media as it scans back and forth across the page (again, in and out of the plane of the drawing) as the page is advanced in the direction of arrow 22 by a paper feeding mechanism (not shown).

As shown in FIG. 1, the pen 20 is disposed above the print media 16 by a distance PPS that is the pen-to-paper spacing. This fixed distance varies from printer to printer, but is usually in the range of 1 to 2 mm. However, maintaining this distance at a set level in a given printer can be advantageous. To ensure high quality prints, it is desirable to accurately control the position of ink drops on the media. Controlling the PPS more accurately improves the positioning of the ink drops. Some printers, particularly lower cost units, do not have the capability for adjustment of the PPS. Such printers are frequently designed to accommodate various thicknesses of print media (e.g. paper, cardstock, etc.) and are expected to tolerate variations in PPS over their lifetimes. For printers of this sort, the corresponding variations in print quality are considered tolerable.

However, print quality requirements for other printers can be much higher, and the allowable variation in PPS is therefore much lower. For example, photo printers, which are intended to produce high resolution photographic images, and which are designed to use only one type of media (e.g. photographic paper) typically have a much tighter tolerance for PPS, in order to produce more consistent high quality prints. In particular, such printing systems frequently are configured to print bi-directionally, which can require much tighter control of PPS. In high quality printers, images are typically printed in multiple passes, so that ink droplets are placed in a given location multiple times. In a bi-directional printer, these passes are made in two directions—(e.g. three passes going forward, backward, then forward again). Variation in the PPS can cause dots printed in the forward and backward directions to not fall on top of each other. Consequently, such printers are configured to allow the PPS to be adjusted, and therefore require a method for checking the PPS.

Advantageously, the inventors have developed a system and method that allows engineers and operators to easily measure the PPS value for a given location on the page, and also to measure PPS variation between different locations on the page. One embodiment of the system is depicted in FIG. 1. Attached to the moveable print head carriage 12 is an optical reflectance sensor 30, which is positioned to shine a light down upon the print media 16 held upon the plate 18, and sense the intensity of reflectance from it. Sensor units that are suitable for use in this system are commercially available from a variety of sources. One such sensor is described in U.S. Pat. No. 6,764,158, "Compact Optical Sensing System," assigned to the assignee of the present invention. This type of sensor is currently used in printer systems to detect and measure color brightness, color hue, and to check pen alignment (i.e. drop placement).

Figure 2:
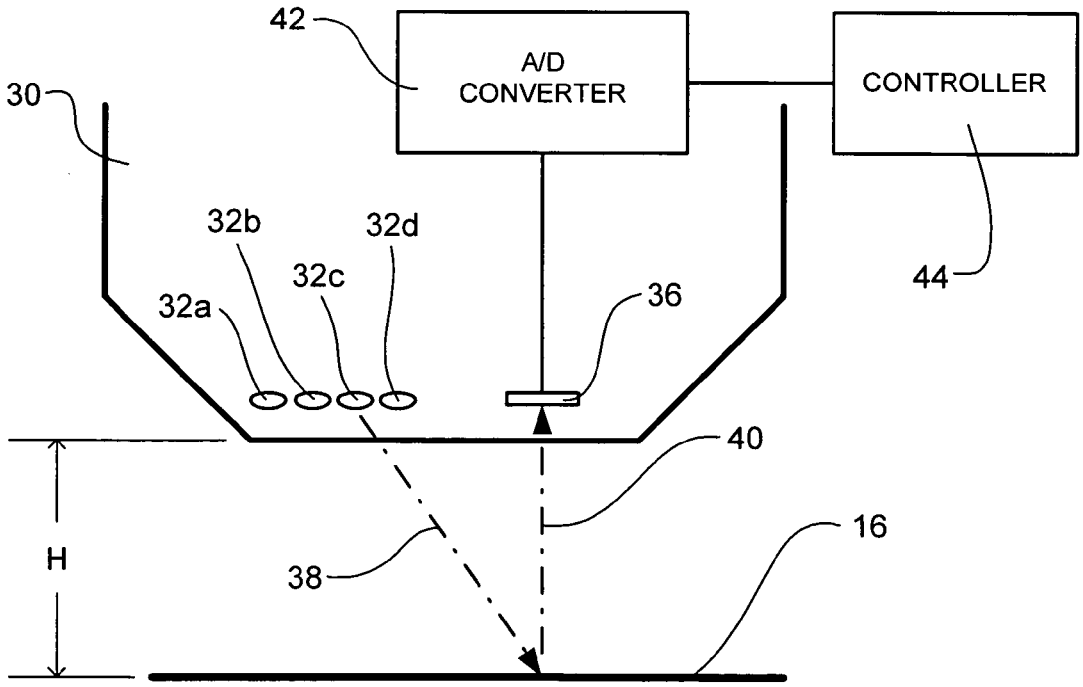
FIG. 2 is a detail view showing an embodiment of a pen-to-paper spacing sensor unit shown in position opposite a piece of print media.

A close-up view of one embodiment of a reflectance sensor that can be used in this system is provided in FIG. 2. The reflectance sensor 30 includes a group of light-emitting elements 32*a-d* (e.g. LEDs), and a light sensor element 36. The sensor element can be a CMOS light-to-voltage diffuse reflectance sensor that produces an output voltage that is proportional to the intensity of incident light. This type of sensor unit can also include a specular reflectance sensor (not shown) that is used in sensing and calibrating for color brightness, color hue, etc. The analog signal from the diffuse sensor element is received by an analog-to-digital (A/D) converter 42, which in turn provides a corresponding digital signal to a controller 44. The controller includes a microprocessor and memory, and can be the controller of the printer as a whole, or it can be a separate controller that is interconnected to the printer controller. This configuration allows the printer carriage position to be correlated with the sensor feedback, which enhances the analysis and interpretation of sensor input. It will also be apparent that the A/D converter can be part of the controller, rather than being a separate element. Either way, the controller receives signals from the reflectance sensor, whether directly or through the A/D converter.

Figure 3:
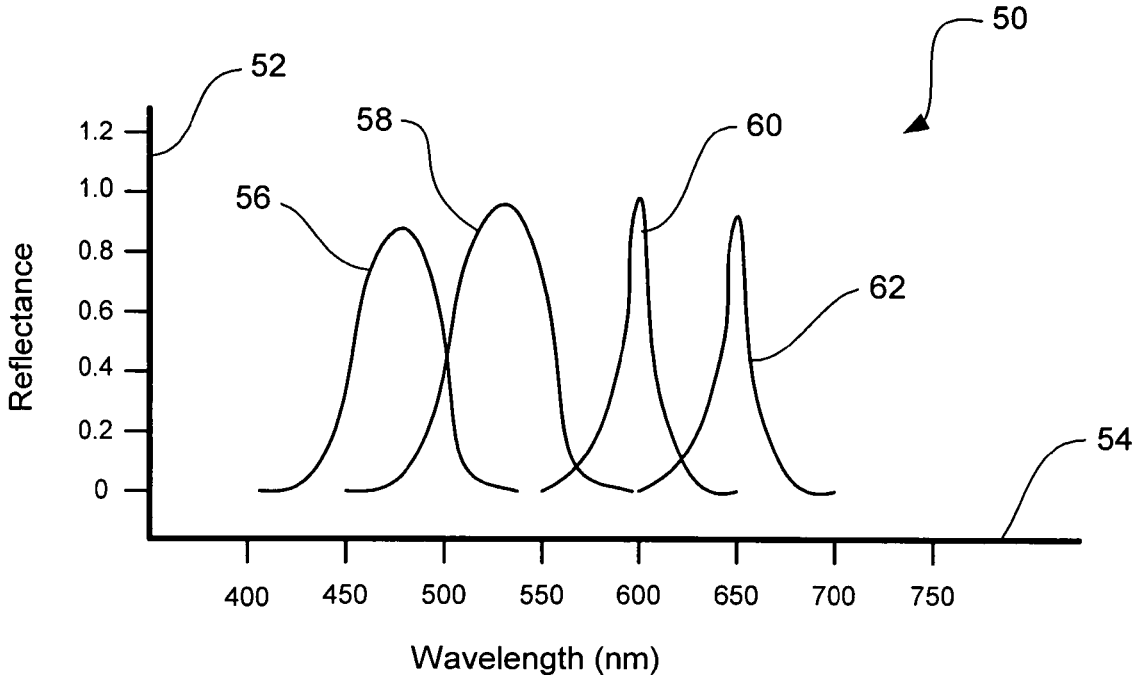
FIG. 3 is a graph of reflectance for different colors of light that can be used in an embodiment of a pen-to-paper spacing detection system.

The four light emitting elements 32 each provide light at a different wavelength. An exemplary graph 50 of the reflectance spectrum for each emitter is shown in FIG. 3, with the horizontal axis 54 representing wavelength of light, and the vertical axis 52 representing the relative reflectance intensity at the given wavelength. In the sensor shown in FIG. 2, light emitter 32*a* can be a red LED providing red light centered at a wavelength of about 460 nm, and corresponding to curve 56 in FIG. 3. Emitter 32*b* in FIG. 2 can be an orange LED that produces orange light at a wavelength of about 520 nm, corresponding to line 58 in FIG. 3. Emitter 32*c* can be a green LED that provides green light at a wavelength of about 600 nm, corresponding to line 60 in FIG. 3, and emitter 32*d* can be a blue LED that provides light centered at about 650 nm, corresponding to line 62 in FIG. 3. When detecting color brightness, color hue, pen alignment, etc., the light from each emitter 32 is directed upon different color patterns printed on a piece of print media, and the corresponding signals from the spectral sensor (not shown) and diffuse sensor elements 36 are converted to a digital signal by the A/D converter 42 and provided to the controller 44. The relative reflectance values obtained from the light of the emitter can then be analyzed, based upon initial calibration values determined and programmed into the controller (e.g. at manufacture of the printer), to allow the system to determine color brightness, etc.

The inventors have found that the diffuse reflectance sensor element 36 is quite sensitive to its spacing from media beneath it. Additionally, detection and analysis of this spacing sensitivity does not require multiple wavelengths of light. Thus, in the present PPS sensor system, only one light emitter and one sensor element need to be used, though multiple light emitters and sensor elements can be used. In the exemplary embodiment shown in FIG. 2, light from the green emitter 32*c*, represented by arrow 38, shines upon the print media 16, and the reflected light, represented by arrow 40, is detected by the diffuse reflectance sensor element 36. The analog voltage signal produced by the diffuse sensor element is converted to a digital signal via the A/D converter 42 and fed to the controller 44, which analyzes the signal. As noted above, the A/D converter can be a part of the controller.

It was noted above that the PPS distance (shown in FIG. 1) is typically on the order of 1 to 2 mm. However, the height H of the sensor unit 30 above the print media, shown in FIG. 2, can be significantly different from this value. For example, the reflectance intensity variation, and therefore the sensitivity of the system to changes in PPS, can vary depending upon the sensor height H due to the divergence of light from the light emitter 32 and other factors. While such is not required, those skilled in the art will recognize that the height H can be chosen to provide optimum sensitivity, depending upon the particular characteristics of the emitter 32 and diffuse sensor element 36. Where the type of reflectance sensor discussed herein has been used to detect and measure color brightness, color hue, pen alignment, etc., a sensor height H of from about 10-12 mm above the print media has been used. The inventors have found that a sensor height in this range is effective for use in the system and method disclosed herein, though sensor heights outside this range can also be suitable.

Figure 7:
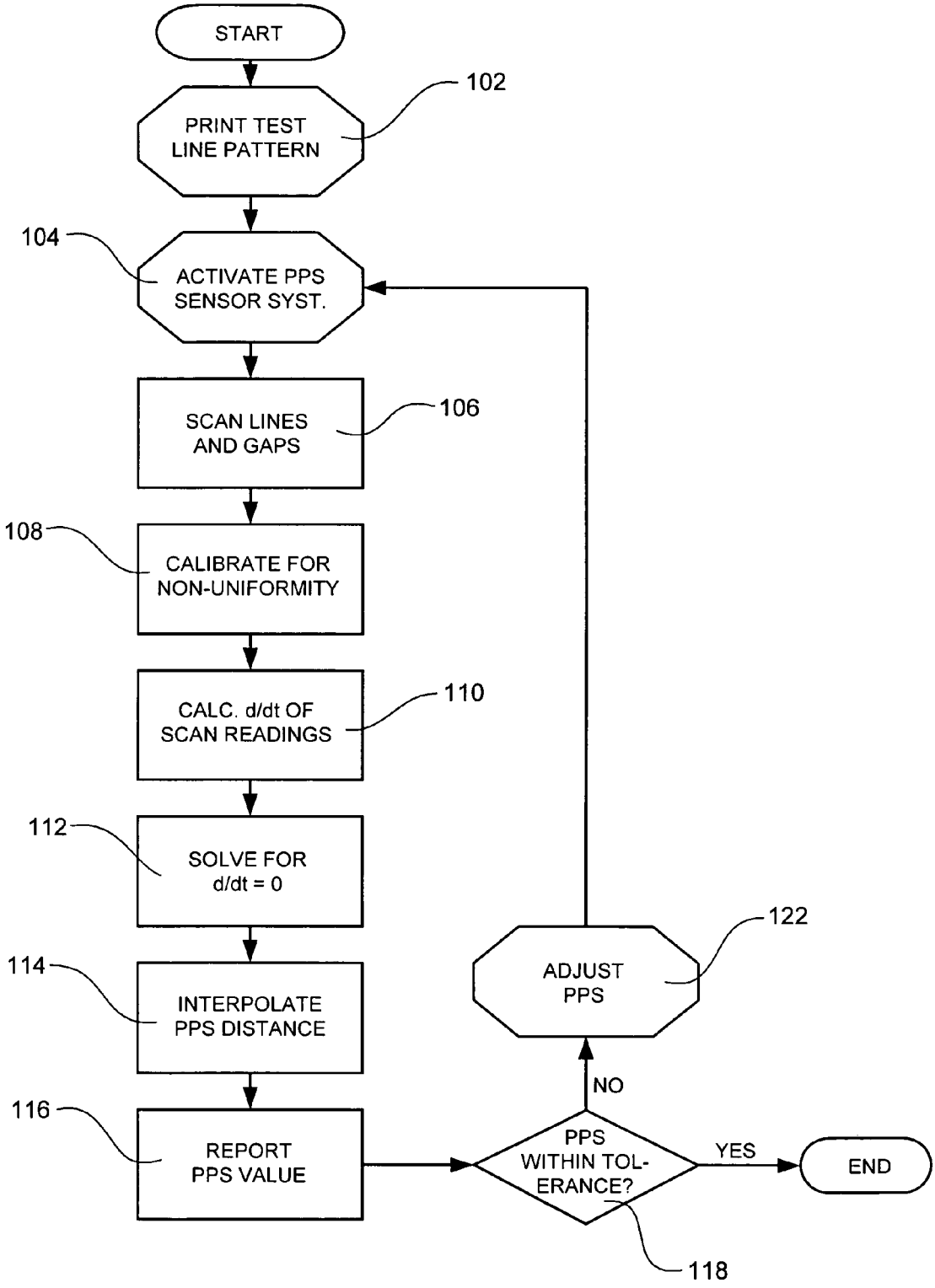
FIG. 7 is a flow chart showing the steps in an exemplary embodiment of a method for detecting pen-to-paper spacing.

In order to determine the absolute PPS value, the system must be initially calibrated at the factory to compensate for the effect of the sensor to paper spacing (SPS), or in other words, the height H of the sensor unit. Shown in FIG. 7 is a flow chart showing the steps in one embodiment of the method for detecting PPS, both during factory calibration and after the printer is put into service. In this flow chart, steps to be carried out by a technician or other individual are provided in octagonal blocks, and steps that are performed by the components of the printer system are shown in rectangular blocks. The first step is to print a test pattern (step 102) upon a piece of print media, which is then placed upon the media support surface (18 in FIG. 1). The test pattern comprises a specific line pattern, which is then scanned with the sensor unit in the manner outlined herein.

Figure 4:
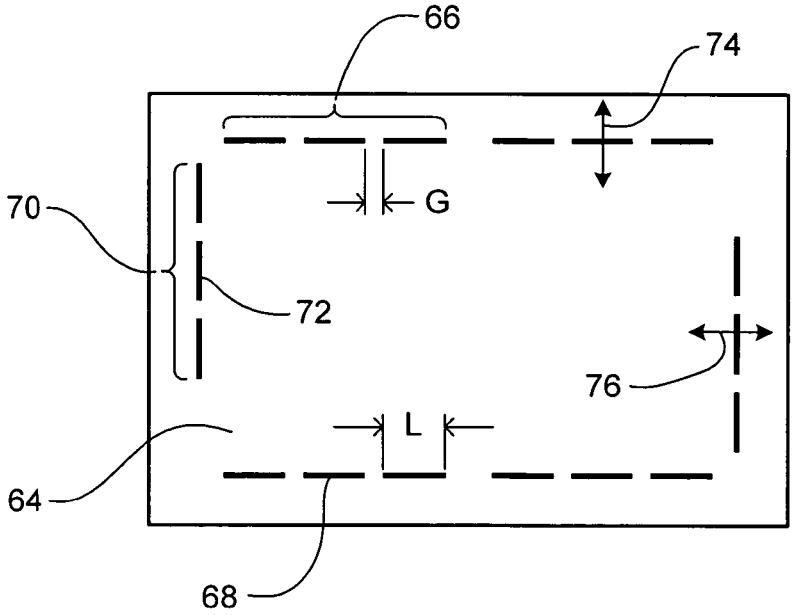
FIG. 4 shows an embodiment of a print pattern that can be provided for use in measuring pen-to-paper spacing in an embodiment of the method.

One example of a line pattern that can be used for scanning to correct for SPS and to detect PPS is shown in FIG. 4. A single piece of print media 70 is imprinted with several groups 72 of horizontal lines 74, and groups 76 of vertical lines 78. The print media shown in FIG. 4 is intended to represent a piece of 4"×6" photographic paper, though it will be apparent that the actual size and shape of the print media having the test pattern can be any size or shape that is compatible with a given printer.

In an alternative embodiment, the line pattern for PPS detection can be permanently imprinted upon the printing surface (18 in FIG. 1) that supports print media during printing. That is, rather than inserting a piece of print media into the printer with the line pattern printed upon it, the surface that supports the media during printing can have the line pattern printed upon it during manufacture. This method ensures that the line pattern and background are always the same, thus preventing inaccuracies in PPS detection from one check to another. It will be apparent that in this embodiment the spacing actually detected will vary from the PPS by the thickness of the print media.

The test pattern includes both horizontal and vertical lines to allow detection of PPS in two dimensions. That is, measurement of PPS in the vertical dimension of the print pattern involves scanning vertically across all of the horizontal lines 68 in the direction of arrow 74. In this mode, the media is moved back and forth in the direction of arrow 74 while the print head (12 in FIG. 1) incrementally moves horizontally across the page, thus allowing the sensor unit (30 in FIG. 1) to scan vertically across each horizontal line. Similarly, measurement of PPS in the horizontal dimension of the print pattern involves scanning horizontally across the vertical lines 72 in the direction of arrow 76. In this mode, the print head is moved back and forth horizontally (in the direction of arrow 76) while the media is incrementally moved in the vertical dimension, to scan horizontally across each vertical line. It will be apparent that this system and method can be configured to scan in only one dimension (either horizontal or vertical), in addition to or in lieu of the two-dimensional capability.

The lines in the line pattern can be of any color ink, so long as the sensor can "see" a reflection from that line color. For example, blue lines will not provide a good reflectance where blue light is used. Likewise, a red sensor beam will not work well with red lines, etc. Since black lines provide good reflectance with any color of light, black lines work very well with this system and method.

In the embodiment of FIG. 4, the lines are positioned near the margins of the paper. This positioning provides a large distance between the respective groups of lines, which helps increase the accuracy of detection of the change in PPS from one side of the media to the other. The size of the space between a line and the edge of the paper is also selected to allow calibration for non-uniformity of paper position, as discussed below.

Figure 5:
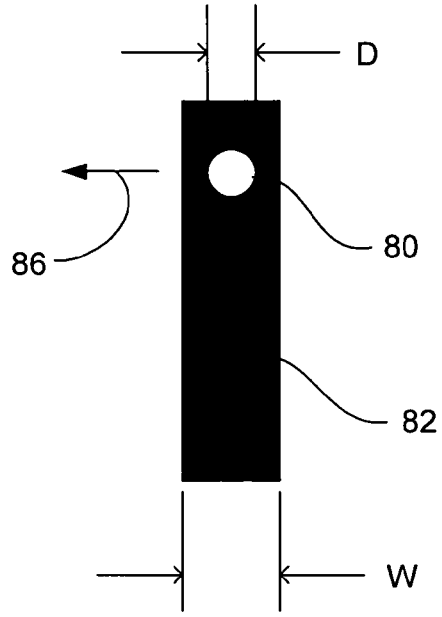
FIG. 5 is a detail view showing a sensor beam outline in relation to a relatively wide print line in an embodiment of a pen-to-paper spacing detection system.

The pre-printed test plot is typically printed under carefully controlled conditions so that the exact positions and dimensions of the lines are correct and correspond to the design dimensions. The horizontal and vertical lines 68, 72, all have a uniform length L, and the gap G between adjacent lines in each group is also of a uniform dimension. These dimensions affect the accuracy of PPS detection, and can be selected relative to the diameter D of the sensor beam, as shown in FIG. 5. It is desirable that the gap G be large enough to allow the sensor beam to pass completely through a gap between adjacent lines, so that the reflection from the gap is purely a paper reflection and is unaffected by the lines on either side. Similarly, it is desirable that the length L of the lines be long enough so that reflections from the line scan are purely line reflections, and are not affected by the unprinted paper regions on either end of the line. In one embodiment, the inventors have selected a gap width G that is at least 5 times the beam diameter, which translates into a gap G of about 4 mm for a beam diameter of about 0.8 mm. It will be apparent that other gap sizes can also be used. Likewise, the inventors have used a line length L that is at least 5 times the beam diameter.

Figure 6:
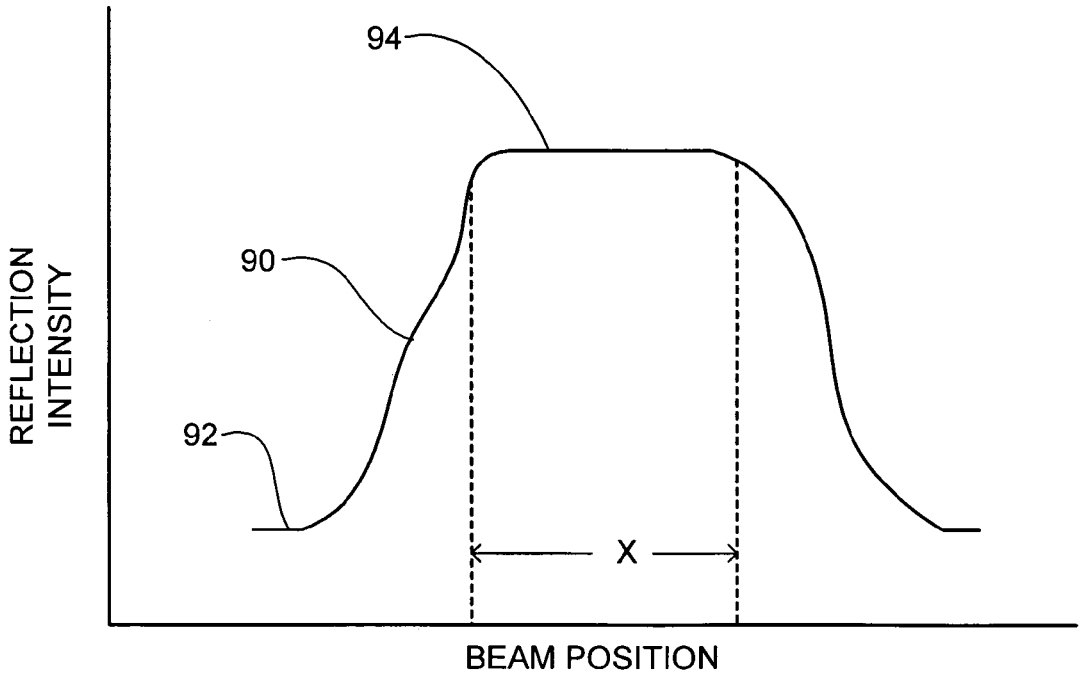
FIG. 6 is an approximate graph of a Gaussian reflectance signal when the sensor beam passes over a print line in an embodiment of a pen-to-paper spacing detection system.

The width W of the lines is also carefully selected, and affects the operation of the system. As shown in FIG. 5B, the sensor beam 80, when incident upon the print media, has a diameter D, which can be compared to the width W of the line 82. In one exemplary embodiment, the line width W is at least two times the beam diameter D. Where the line is wider than the sensor beam 80, there is an interval during which the entire beam is incident upon the line as the beam travels laterally over the line in the direction of arrow 86. The reflectance sensed in this situation produces a Gaussian curve approximately represented by the solid line curve 90 in the graph of FIG. 6. Where the sensor is not incident upon the line, the sensor returns a base reflectance reading as indicated at 92. However, upon encountering the line, the reflectance reading will spike upward to some maximum value, and produce a relatively flat plateau 94, before dropping down again as the sensor moves off the other edge of the line. Where the width W of the line is greater than the beam diameter D, there will be a distance X between the rise and fall of the Gaussian signal that is substantially fixed for the given line width. During calibration of the printer at the factory, the PPS is initially set using external tools, so that the width W of the test pattern lines that are printed will have the desired value, and the corresponding value X can likewise be calculated. These two known values, X and W, are stored in memory as calibration parameters of the PPS.

After these values are stored, the factory calibration of the system continues as outlined in FIG. 7. First, the test pattern is printed (step 102) bi-directionally. Printing the test pattern bi-directionally is desirable since the effect of PPS variation is only observed when the dots in forward and backward directions are not falling on top of each other, as noted above. This print is made after the initial automatic pen alignment (APA) adjustment is made so that the alignment of the pens is accurate.

If the PPS varies from the design settings, the width W of the printed lines will vary from the design values, and this variation will be detected by the PPS scanning system. Accordingly, the next step is to scan the test pattern to measure the distance $X_{new}$ between the rise and fall of the Gaussian curve. Scanning the test pattern first requires that the PPS scanning system be activated (step 104). This step can include activating one of the emitters (e.g. the green LED) for a startup time interval (e.g. 30 seconds) to allow the emitter to warm up so as to produce a consistent beam.

The PPS sensor system then scans the line/space pattern (step 106) horizontally and/or vertically using that single emitter, with the analog sensor data being continuously converted to digital form (by the A/D converter 42 in FIG. 2) and fed to the controller (44 in FIG. 2), which stores these values in memory for computational purposes. The PPS scan can also be performed bi-directionally, in the same way the printer prints bi-directionally.

In order to compensate for any variation in the SPS (the height H of the sensor unit), the sensor readings are mathematically calibrated (by the controller) for non-uniformity (step 108). This is done by dividing the sensor readings by the reflectance readings obtained on either side of the printed lines in the test pattern. This step is intended to compensate for wrinkles or other non-uniformity in the print media that causes slight deviation in the PPS. One source of non-uniformity in the print media can be caused by a vacuum non-uniformity. In some high quality ink jet printing systems, the print media support surface (18 in FIG. 1) can be a cylindrical drum, upon which the print media is held by vacuum pressure. It is known that the vacuum pressure exerted upon the print media in such a system can be uneven across the entire page, allowing some regions of the print media to bulge away from the media support surface, thus lowering the PPS in that immediate area. For example, vacuum non-uniformity can exist toward the edges of the print media, allowing the edges of the print media to be closer to the pen or sensor. When the sensor is closer to the print media, the sensed reflectance (both of lines and gaps) will be higher than otherwise. Compensation for this type of non-uniformity of the position of the media is made by dividing the scan data (i.e. the absolute sensor reading) of each scan line by the average of the scans of gaps (i.e. white spaces) on either side of the line. Dividing the absolute sensor reading by the average sensor reading for the closest adjacent gaps will eliminate the variation due to media non-uniformity.

Calibration for non-uniformity also has the added advantage of compensating for diminishing output of the LED emitters due to age and/or aerosol coating of the sensor lenses over time. The light output intensity of LEDs can vary over time. Additionally, as an ink jet printer is used, small quantities of ink in aerosol form can gradually coat the lenses of the PPS sensor unit (30 in FIG. 2). Such aerosol coating will tend to diminish the intensity of the scan beam (38 in FIG. 2), and will also tend to diminish the sensor reading obtained from that beam by the diffuse sensor (36 in FIG. 2). However, for both a change in LED intensity and aerosol coating of the lenses, the reflectance readings will also be diminished for the background or unprinted portions of the print pattern. By dividing all scan data by the average of scans outside the lines, the system will automatically compensate for the effects of LED deterioration and minor aerosol coating of the sensor lenses over time.

Following this calibration, the system then calculates the derivative of the scan readings (step 110) and determines the scan values where the derivative of the variation in reflectance intensity is equal to or close to zero (step 112). Since this derivative calculation is performed numerically, the number of calculations required will depend upon the resolution used. The inventors have found that calculating the derivative using a window of 2 to 3 dots on each side of a data point (i.e. reflectance measurement location) provides sufficient accuracy without requiring excessive calculations, but it will be apparent that the appropriate resolution will depend upon the computational power of the system. Calculating the derivative and solving for zero allows the system to determine the location of the edges of the lines in the test pattern, which allows the system to determine the width $W_{new}$ of the lines on the test pattern. That is, the locations where the data values have a zero derivative represent the plateaus of the Gaussian reflectance curves. Determining the transition locations at the edges of these plateaus allows the controller to determine the boundaries for the value $X_{new}$, which in turn corresponds to the locations of the edges of the lines in the test pattern.

Once $X_{new}$ has been determined, the next step is to determine the detected line width $W_{new}$ to determine the PPS. Knowing X and W (which have been stored in memory), $W_{new}$ can be calculated according to the following equation:

$$W_{new}=X_{new}*(W/X) \quad \text{eq. 1}$$

This equation assumes that the distance relation between X and W is linear, which is generally a correct assumption given that the total possible variation of PPS is very limited in the first place. Having now determined $W_{new}$, this value can be compared to values in a look-up table that is stored in memory to determine the actual PPS. This lookup table may be calculated once in the factory, and essentially represents the relationship between sensor distance and line width reading values. Based upon this comparison, the controller determines whether the PPS value is within tolerance by numerically interpolating the calculated value of $W_{new}$ into the look-up table to determine the magnitude and direction of the variation in PPS (step 114). The system then reports this value to the user (step 116) via any suitable user interface (e.g. computer monitor, LCD display, etc.).

The PPS variation data that is reported to the user can indicate the absolute value of the PPS at multiple locations on the test page, or can simply indicate the variation of PPS from one side of the page to the other (in either dimension, and at multiple locations). If the PPS is not within tolerance, the system will indicate the magnitude and location of the variation, and the worker may then adjust the printer to either increase or decrease the PPS (step 122) at any of various locations within the printer. The mechanism for making this adjustment is not shown in the drawings, but can include set screws or adjustment screws at each end of each print head carriage rail (14 in FIG. 1) that allow a worker to independently raise or lower each end of the rails. Thus, if the PPS is low on one end and high on the other, the worker can raise the first end and lower the second end of the rails, respectively. Following the worker's adjustment of the PPS, the worker can return to step 104 and again activate the PPS sensor system to repeat the process and determine whether the PPS adjustment has been effective.

The PPS detection procedure typically ends once the PPS detection routine returns an indication that the PPS is within tolerance throughout the page. It will be apparent that during calibration of the system in the factory, with the PPS having been initially set using external tools and the test pattern having been printed with known dimensions, the initial detection of PPS should show no variation from the design settings.

The system and method disclosed herein is relatively inexpensive, accurate, and simple to employ. Additionally, the PPS measurement process is fast, and is not affected by aerosol and LED intensity. This system and method applies to any ink jet printer having an adjustable pen-to-paper spacing, and can automatically detect PPS non-uniformity using the kind of hardware that is already present in many ink jet printers for pen alignment and color calibration. Using this hardware, the PPS check can easily be run before running other tests, such as color brightness, color hue and ink placement, and can therefore simplify maintenance procedures. Additionally, the use of hardware that is already present in the printer eliminates the need for an expensive external tool for PPS detection and the need for extensive training of personnel in the use of such a tool.

Although described with respect to an exemplary ink jet printing system, it should be apparent to one skilled in the art that embodiments of the invention may be employed with any printing system having a suitable optical sensor.

It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. A system for detecting pen-to-paper spacing (PPS) in a printing system having a pen attached to a moveable print head positioned near a print media position, comprising:

a) a test pattern, at the print media position, comprising printed lines having a line width W;

b) a sensor device, attached to the print head, positioned to shine a beam of light having a diameter D that is less than W upon, and detect light reflected from the test pattern as the print head scans across the test pattern; and c) a controller, connected to receive reflectance signals from the reflectance sensor, and configured to calculate a derivative of scan readings and solve for zero to determine locations of line edges to determine the line width W in the test pattern and compare said line width with a predetermined line width values for the test pattern to determine variation in the PPS.

2. A system in accordance with claim 1, wherein the test pattern comprises horizontal and vertical lines.

3. A system in accordance with claim 2, wherein the test pattern comprises lines printed on print media.

4. A system in accordance with claim 3, wherein the horizontal and vertical lines are disposed near margins of the print media.

5. A system in accordance with claim 1, wherein the test pattern comprises lines printed upon a media support surface disposed at the print media position.

6. A system in accordance with claim 1, wherein the emitter comprises an LED.

7. A system in accordance with claim 1, wherein the reflectance sensor comprises a diffuse reflectance sensor.

8. A printing system, comprising:

a) a pen, attached to a moveable print head positioned at a pen-to-paper spacing (PPS) from a print media position;

b) a sensor, attached to the print head, including i) an emitter aimed to direct a beam of light, having a diameter D, toward the print media position; and ii) a reflectance sensor, positioned to detect light reflected from a test pattern, located at the print media position, as the print head scans across the test pattern, the test pattern comprising lines printed by the inkjet printer having a line width W that is at least two times D; and c) a controller, connected to receive reflectance signals from the reflectance sensor, and to calculate a derivative of scan readings and solve for zero to determine locations of line edges to determine the line width and compare the line width with a predetermined value thereof in a table stored in memory, to determine variation in the PPS.

9. A printing system in accordance with claim 8, wherein the test pattern comprises a pattern of lines bi-directionally printed upon print media by the printer.

10. A system in accordance with claim 8, wherein the test pattern comprises horizontal and vertical lines.

11. A system in accordance with claim 10, wherein the test pattern comprises lines printed on print media.

12. A system in accordance with claim 11, wherein the horizontal and vertical lines are disposed near margins of the print media.

13. A system in accordance with claim 8, wherein the test pattern comprises lines printed upon a media support surface disposed at the print media position.

14. A system in accordance with claim 8, wherein the reflectance sensor comprises a diffuse reflectance sensor.

15. A system for detecting pen-to-paper spacing (PPS) in an inkjet printing system having a print head, comprising:

a) a test pattern, at a print media position, comprising lines having a line width;

b) a sensor, positioned to shine a beam of light upon the test pattern and to detect light reflected from the test pattern while scanning thereacross; and c) a controller, configured to receive reflectance signals from the sensor, to calculate a derivative of the reflectance signals and solve for zero to determine locations of line edges to thereby determine the line width, and to compare the line width with a predetermined line width value to determine the PPS.

16. A system in accordance with claim 15, wherein the test pattern is selected from the group consisting of lines printed on print media and lines disposed upon a media support surface at the print media position.

17. A system in accordance with claim 16, wherein the test pattern comprises a pattern of lines bi-directionally printed upon print media by the printer.

18. A system in accordance with claim 15, wherein the line width is at least about two times a diameter of the beam of light.

19. A system in accordance with claim 15, wherein the emitter comprises an LED and the sensor comprises a diffuse reflectance sensor.

* * * * *

UNITED STATES PATENT AND TRADEMARK OFFICE

CERTIFICATE OF CORRECTION

PATENT NO. : 7,588,302 B2
APPLICATION NO. : 11/496371
DATED : September 15, 2009
INVENTOR(S) : Behnam Bastani et al.

It is certified that error appears in the above-identified patent and that said Letters Patent is hereby corrected as shown below:

In column 9, line 24, in Claim 1, delete "values" and insert -- value --, therefor.

Signed and Sealed this

Fifth Day of October, 2010

David J. Kappos

David J. Kappos
*Director of the United States Patent and Trademark Office*